US007252073B1

(12) United States Patent
Nakahira et al.

(10) Patent No.: US 7,252,073 B1
(45) Date of Patent: Aug. 7, 2007

(54) ENGINE TIMER FOR COLD-START ADVANCE

(75) Inventors: Toshio Nakahira, Sakai (JP); Atsushi Yamaguchi, Izumiotsu (JP); Mikio Ishida, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 11/530,244

(22) Filed: Sep. 8, 2006

(51) Int. Cl.
*F02M 37/04* (2006.01)

(52) U.S. Cl. ..... 123/501; 123/500; 123/502; 464/2

(58) Field of Classification Search ..... 123/501, 123/502, 500; 464/2, 3, 4, 5, 6
See application file for complete search history.

(56) References Cited

U.S. PATENT DOCUMENTS

| | | | | |
|---|---|---|---|---|
| 4,548,182 | A * | 10/1985 | Kamleitner | 123/501 |
| 4,572,144 | A * | 2/1986 | Handa | 123/501 |
| 4,995,368 | A * | 2/1991 | Nakamura et al. | 123/501 |
| 4,998,523 | A * | 3/1991 | Geyer et al. | 123/502 |
| 5,131,374 | A * | 7/1992 | Morin | 123/502 |
| 6,289,860 | B1 * | 9/2001 | Speckhart et al. | 123/90.15 |
| 6,336,433 | B1 * | 1/2002 | Anton et al. | 123/90.17 |

FOREIGN PATENT DOCUMENTS

| | | | |
|---|---|---|---|
| JP | 3-11131 | A | 1/1991 |
| JP | 2004-116500 | A | 4/2004 |
| JP | 2005-273519 | A | 10/2005 |
| JP | 2006-90213 | A | 4/2006 |
| JP | 2006-250013 | A | 9/2006 |

* cited by examiner

*Primary Examiner*—Tony M. Argenbright
*Assistant Examiner*—J. Page Hufty
(74) *Attorney, Agent, or Firm*—Akin Gump Strauss Hauer & Feld LLP

(57) ABSTRACT

Each of paired centrifugal weights are interlockingly connected to an advancing spring, which is interlockingly connected to a temperature-sensing operation device. When cold-starting the engine, the advancing spring is maintained extensible based on a state of the temperature-sensing operation in which the temperature-sensing operation device senses a temperature to operate. This advancing spring exerts a spring force, which pushes and widens the paired centrifugal weights to an advancing position. While the engine is warm, the advancing spring is held contracted based on another state of the temperature-sensing operation device, in which the temperature-sensing operation device senses a temperature to operate, so that the spring force of the advancing spring does not act on the paired centrifugal weights. A shape memory spring composed of a compression coil spring is used for the temperature-sensing operation device.

8 Claims, 7 Drawing Sheets

20
3
40
45
48
44
(44a)
31
41
-28-
-22-
-29-
25
4
B
C
3d
23
2a
2
1
27
1a
25c
25b
24
27b
27a
29
22
18
14
6
7(8)
9
5
28

ENGINE TIMER FOR COLD-START ADVANCE

BACKGROUND OF THE INVENTION

Technical Field

The present invention concerns an engine timer and more specifically, an engine timer able to reduce the resistance of the transmission from an advancing spring to a pair of centrifugal weights and beside to be made compact.

There is an example of the conventional engine timers, disclosed by Japanese Patent Application Laid-Open (Kokai) No. 3-11131. This timer comprises a pair of centrifugal weights 103, 103 interlockingly connected to an advancing spring 106 composed of a compression coil spring as shown in FIG. 7(A) like the present invention. This advancing spring 106 is interlockingly connected to a temperature-sensing operation means 107. When starting the engine during a cold term, the advancing spring 106 is maintained extensible, based on a state of the temperature-sensing operation means 107 in which the temperature-sensing operation means 107 senses a temperature to operate. This advancing spring 106 exerts a spring force which pushes and widens the pair of centrifugal weights 103, 103 to an advancing position for cold-staring the engine. While the engine is warm, the advancing spring 106 is maintained contracted based on another state of the temperature-sensing operation means 107 in which the temperature-sensing operation means 107 senses a temperature to operate, so that the spring force of the advancing spring 106 does not act on the pair of centrifugal weights 103, 103.

The engine timer of this kind, when starting the engine during the cold term, pushes and widens the pair of centrifugal weights 103, 103 to the advancing position for cold-starting the engine and smoothly performs the cold-starting by advancement. When the engine senses a temperature to start or it is in operation, the advancing spring 106 does not act its spring force on the pair of centrifugal weights 103, 103 so as to inhibit unnecessary advancement with the result of improving the exhaust-gas property.

However, the conventional engine timer uses a wax 150 for the temperature-sensing operation means 107 as shown in FIGS. 7(A) and 7(B). This wax 150 and the advancing spring 106 are placed in a position perpendicular to a weight-return spring 105 and are arranged along an axis 118 of a rotary shaft 122. A transmission force is conducted from the advancing spring 106 to the pair of centrifugal weights 103, 103 through a tapered cam 151. This entails problems.

The conventional technique has the following problems.

<Problem> There Exists a Large Resistance of Transmission from the Advancing Spring to the Pair of Centrifugal Weights.

As shown in FIGS. 7(A) and 7(B), the transmission force is conducted from the advancing spring 106 to the pair of centrifugal weights 103, 103 through the tapered cam 151. Therefore, the friction of the tapered cam 151 enlarges the resistance of transmission from the advancing spring 106 to the pair of centrifugal weights 103, 103. This lowers the accuracy of the advancement when starting the engine during the cold term and requires an advancing spring 106 and a temperature-sensing means 107 each of which is large and produces a high output. Further, there is caused a problem that the tapered cam 151 is worn off to result in reducing the durability.

<Problem> Enlargement of the Timer

As shown in FIGS. 7(A) and 7(B), the wax 150 and the advancing spring 106 are placed in the position perpendicular to the weight-return spring 105 and are arranged along the axis 118 of the rotary shaft 122. This elongates the timer in an axial direction of the rotary shaft 122. Thus it is required to provide an advancing spring 106 and a temperature-sensing means 107 each of which is large and produces a high output and at the same time the timer becomes large.

SUMMARY OF THE INVENTION

The present invention has an object to provide an engine timer able to solve the above-mentioned problems and particularly an engine timer capable of reducing the resistance of transmission from an advancing spring to a pair of centrifugal weights and of being made compact.

The present invention has the following principal construction.

As exemplified in FIG. 2, a driving wheel 1 is attached to a predetermined rotary shaft 22. The driving wheel 1 has one lateral portion at which a driven wheel 2 is arranged and has the other lateral portion at which a pair of centrifugal weights 3, 3 are arranged, respectively. As exemplified in FIG. 1(A), each of the centrifugal weights 3 is urged in a centripetal direction by a weight-return spring 5 composed of a compression coil spring. As illustrated in FIG. 2, there is provided between the driving wheel 1 and the driven wheel 2 an eccentric cam mechanism 4, which is interlockingly connected to the pair of centrifugal weights 3, 3.

A force of unbalance between the centrifugal force of each of the centrifugal weights 3 and the urging force of the weight-return spring 5 operates each of the centrifugal weights 3. While each of the weights 3 is moved in a centrifugal direction, thereby advancing the driven wheel 2 with respect to the driving wheel 1 through the eccentric cam mechanism 4, it is moved in a centripetal direction, thereby allowing the driven wheel 2 to lag with respect to the driving wheel 1 through the eccentric cam mechanism 4.

As exemplified in FIG. 1(A), each of the centrifugal weights 3 is interlockingly connected to the advancing spring 6 composed of a compression coil spring. The advancing spring 6 is interlockingly connected to a temperature-sensing operation means 7. As illustrated in FIG. 4(A), when starting the engine during a cold term, the advancing spring 6 is maintained extensible based on a state of the temperature-sensing operation means 107 in which the temperature-sensing operation means 107 senses a temperature to operate. The advancing spring 6 exerts a spring force which pushes and widens the pair of centrifugal weighs (3, 3) to an advancing position (Ac) for cold-staring the engine. As shown in FIG. 4(B), while the engine is warm, the advancing spring 6 is held contracted based on another state of the temperature-sensing operation means 7 in which the temperature-sensing operation means 7 senses a temperature to operate, so that the spring force of the advancing spring 6 does not act on the pair of weights 3, 3.

As exemplified in FIG. 1(A), a shape memory spring 8 composed of a compression coil spring is employed for the temperature-sensing operation means 7. This shape memory spring 8 and the advancing spring 6 are interposed between the pair of centrifugal weights 3, 3 in a position concentric with the weight-return spring 5

The present invention offers the following effects.

<Effect> It is Possible to Reduce the Resistance of Transmission from the Advancing Spring to the Pair of Centrifugal Weights.

As shown in FIG. 1(A), the advancing spring 6 is interposed between the pair of centrifugal weights 3, 3 in a position concentric with the weight-return spring 5. This makes it possible for the spring force of the advancing spring 6 to directly push and widen the pair of centrifugal weights to the advancing position (Ac) without using the spring-force transmission means which changes the operation direction of the spring force of the advancing spring 6 such as a tapered cam. This can obviate the loss of transmission force from the advancing spring 6 to the pair of centrifugal weights 3, 3 with the result of increasing the accuracy of advancement when starting the engine during the cold term. Further, it suffices if the advancing spring 6 and the temperature-sensing operation means 7 may be small and may produce low output. Additionally, there is not caused the disadvantage of reducing the durability due to the wearing-off of the spring-force transmission means.

<Effect> the Timer can be Made Compact.

As exemplified in FIG. 1(A), the shape memory spring 8 composed of a compression coil spring is used for the temperature-sensing operation means 7. This shape memory spring 8 and the advancing spring 6 are interposed between the pair of centrifugal weights 3, 3 in a position concentric with the weight-return spring 5. Therefore, as shown in FIG. 2, the timer 20 is not elongated in the axial direction of the rotary shaft 22. This makes it sufficient even if each of the advancing spring 6 and the temperature-sensing operation means 7 is small and produces a low output. In addition, the timer can be made compact.

<Effect> it is Possible to Smoothly Start the Engine During the Cold Term and to Improve the Exhaust-Gas Property while the Engine is Warm.

As exemplified in FIG. 5(A), when starting the engine during the cold term, an upper limit of the movement of every centrifugal weight 3 in the centrifugal direction is confined to a first limiting position of advancement (L1). While the engine is warm, the upper limit of the movement of every centrifugal weight 3 in the centrifugal direction is confined to a second limiting position of advancement (L2). If the second limiting position of advancement (L2) is arranged so that the upper limit of the movement of every centrifugal weight 3 in the centrifugal direction is set lower to make an upper limit of a degree of advancement (θ) lower when compared with the first limiting position of advancement, it offers the following advantages.

When starting the engine during the cold term, the engine can be smoothly started by setting the upper limit of the degree of advancement (θ) higher. Besides, while the engine is warm, the exhaust-gas property can be improved by setting the upper limit of the degree of advancement (θ) lower.

BRIEF DESCRIPTION OF THE DRAWINGS

FIG. 1 shows an engine timer according to an embodiment of the present invention.

FIG. 3 is an explanatory view of the timer shown in FIG. 1.

FIG. 4 shows a state of a temperature-sensing operation means of the timer shown in FIG. 1 in which the temperature-sensing operation means senses a temperature to operate.

FIG. 5 shows an advancement limiting state of the timer shown in FIG. 1.

FIG. 6 is a graph which shows a characteristic of the advancement limiting state of the timer shown in FIG. 1. FIG. 7 shows an engine timer according to a conventional technique.

MOST PREFERRED EMBODIMENT OF THE INVENTION

An embodiment of the present invention is explained based on the drawings. FIGS. 1 to 6 show an engine timer according to the embodiment of the present invention. In this embodiment, an explanation is given for a timer of a diesel engine.

The embodiment of the present invention is outlined as follows.

Figure 2:
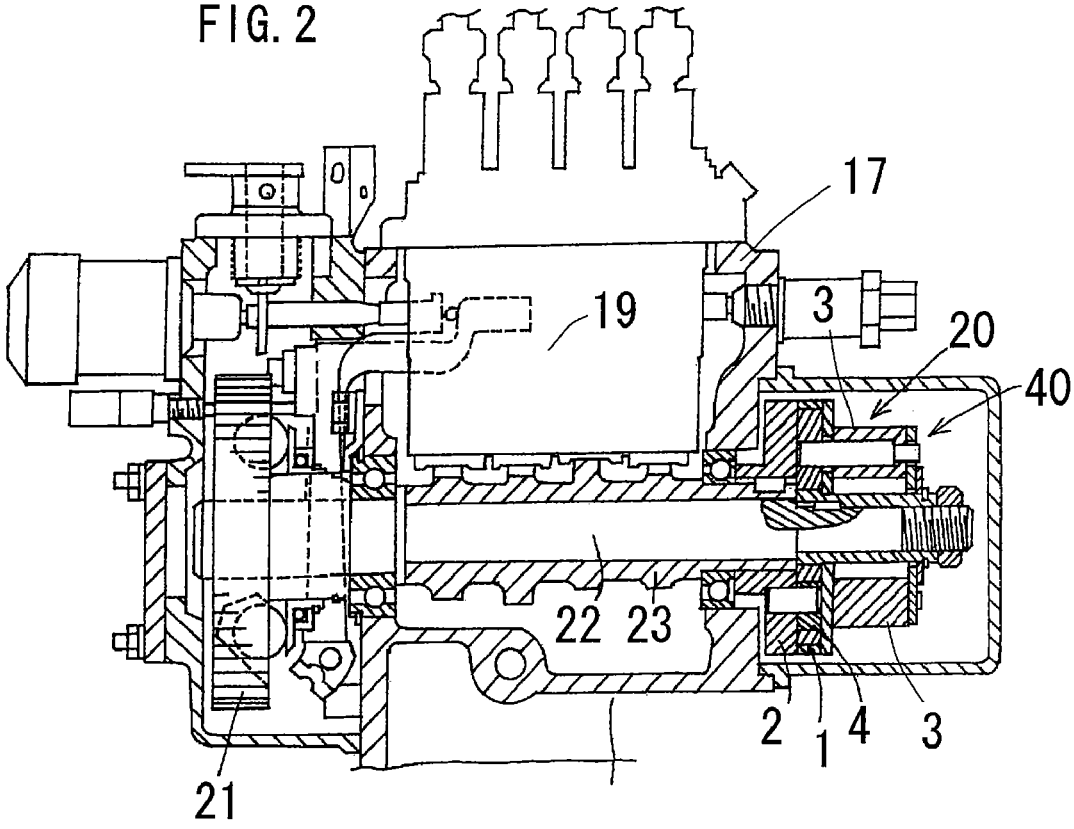
FIG. 2 shows a vertical sectional right side view of a driving device for a fuel injection pump of a diesel engine which utilizes the timer shown in FIG. 1.

As shown in FIG. 2, a pump accommodating chamber 17 accommodates a fuel injection pump 19 and a fuel injection cam shaft 23 below the fuel injection pump 19. An input rotary shaft 22 passes through the fuel injection cam shaft 23 and has one end portion to which an input gear 21 is attached. The input rotary shaft 22 has the other end to which a driving wheel 1 is fixed. The driving wheel 1 has one lateral portion at which a driven wheel 2 is disposed. This driven wheel 2 is secured to the fuel injection cam shaft 23. The driving wheel 1 has the other lateral portion at which a pair of centrifugal weights 3, 3 are arranged. Each of the centrifugal weights 3 is biased in a centripetal direction by a weight-return spring 5 composed of a compression coil spring. There is provided between the driving wheel 1 and the driven wheel 2 an eccentric cam mechanism 4, which is interlockingly connected to the pair of centrifugal weights 3, 3.

The eccentric cam mechanism has the following structure.

Figures 3A, 3B, 3C:
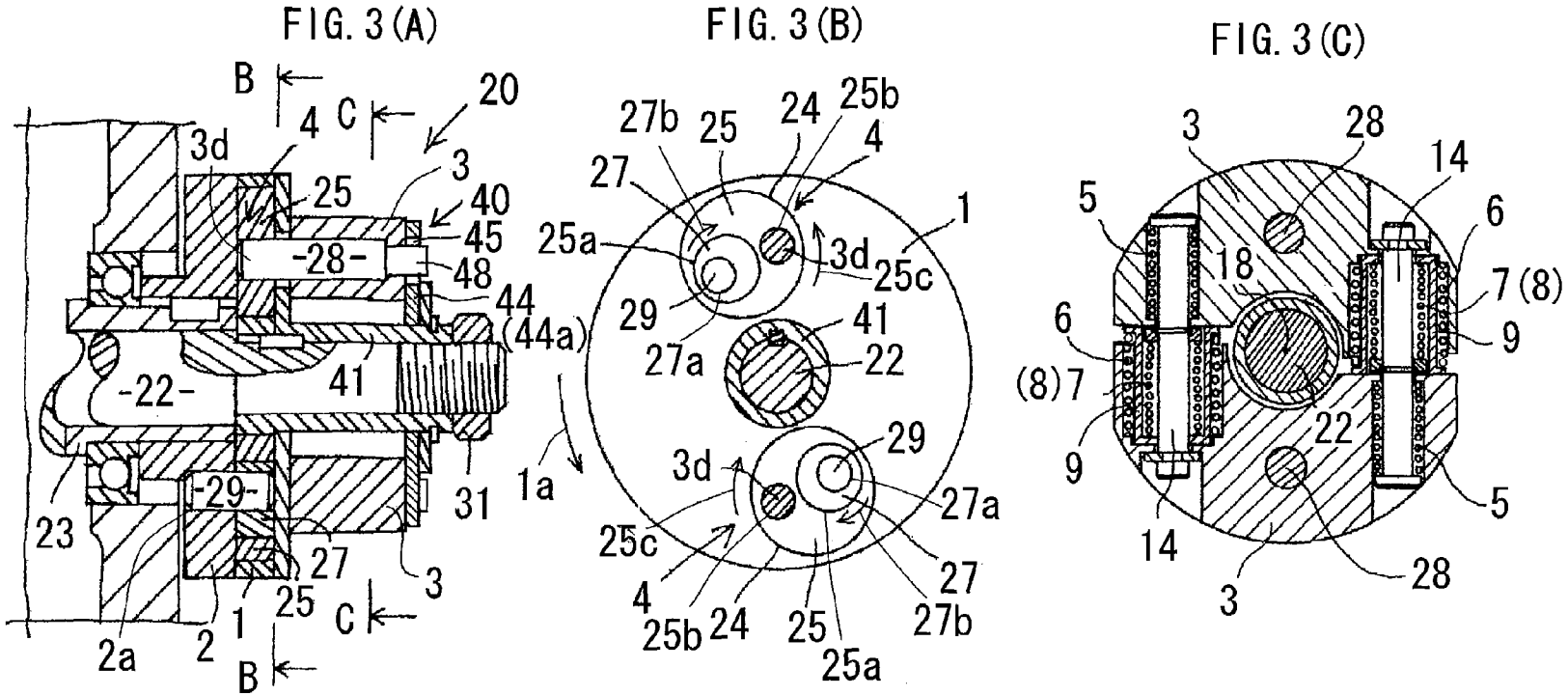
FIG. 3(A) is a vertical sectional right side view.
FIG. 3(B) is a sectional view taken along a line B-B in FIG. 3(A).
FIG. 3(C) is a sectional view taken along a line C-C in FIG. 3(A)

As shown in FIG. 3(B), the driving wheel 1 is opened to provide a pair of larger-diameter disk cams 24, 24, into which larger-diameter disk cams 25 are internally fitted. Each of the larger-diameter disk cams 25 is opened to provide a smaller-diameter cam hole 25*a* and a pin hole 25*b*. A smaller-diameter disk cam 27 is internally fitted into every smaller-diameter cam hole 25*a*. Each of the centrifugal weights 3 projects an output pin 3*d* which is internally fitted into the pin hole 25*b*. Each of the smaller-diameter disk cam 27 is opened to provide a pin hole 27*a* into which an output pin 29 projecting into the driven wheel 2 is internally fitted. As shown in FIG. 3(A), this output pin 29 is internally fitted into the pin hole 2*a* of the driven wheel 2.

A degree of advancement is adjusted by the operation of the eccentric cam mechanism as follows.

A force of unbalance between a centrifugal force of each of the centrifugal weights 3 and a biasing force of the weight-return spring 5 operates the respective centrifugal weights 3 to move them in a centrifugal direction. This advances the driven wheel 2 with respect to the driving wheel 1 through the eccentric cam mechanism 4. When the respective centrifugal weights 3 are moved in a centripetal direction, the driven wheel 2 is made to lag with respect to the driving wheel 1 through the eccentric cam mechanism 4. Concretely, as shown in FIG. 3(B), when the respective centrifugal weights 3 are moved in the centrifugal direction to displace the output pin 3*d* from each of the centrifugal weights 3 in the centrifugal direction, the larger-diameter disk 25 is rotated in a direction indicated by an arrow 25*c* and the smaller-diameter disk 27 is rotated in a direction indicated by an arrow 27*b*. The output pin 29 to the driven wheel 2 is shifted toward a downstream side of a rotation direction 1*a* of the driving wheel 1 and the driven wheel 2 is shifted toward the downstream side of the rotation direction 1*a* with respect to the driving wheel 1. Therefore, the driven wheel 2 advances with respect to the driving wheel 1. When the respective centrifugal weights 3 are moved in the centripetal direction to displace the output pin 3*d* from each of the centrifugal weights 3 in the centripetal direction, the larger-diameter disk 25 is rotated in a direction opposite to the above-mentioned one as well as the smaller-diameter disk 27. Therefore, the output pin 29 into the driven wheel 2 is shifted toward an upstream side of the rotation direction 1*a* of the driving wheel 1 and the driven wheel 2 is shifted toward the upstream side of the rotation direction 1*a* with respect to the driving wheel 1, thereby allowing the driven wheel 2 to lag with respect to the driving wheel 1. Therefore, the engine rotates at an increased speed to increase the centrifugal force of each of the centrifugal weights 3. Then the fuel injection cam shaft 23 advances to accelerate the timing for fuel injection. On the other hand, when the engine rotates at a decreased speed to decrease the centrifugal force of each of the centrifugal weights 3, the fuel injection cam shaft 23 lags to delay the timing for fuel injection.

The structure for obtaining the advancement on cold-starting an engine is as follows.

Figure 1D:
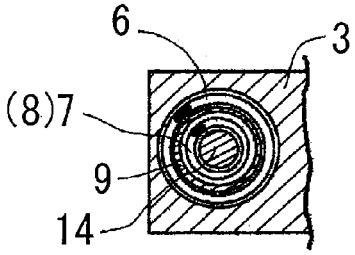
FIG. 1(D) is a sectional view taken along a line D-D in FIG. 1(A).
Figure 1B:
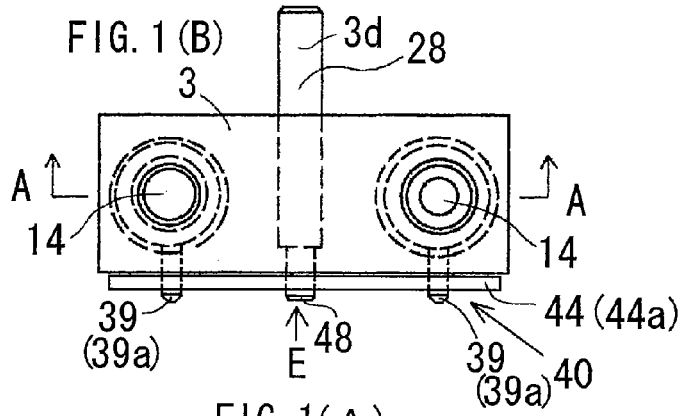
FIG. 1(B) is a top view.
Figure 1C:
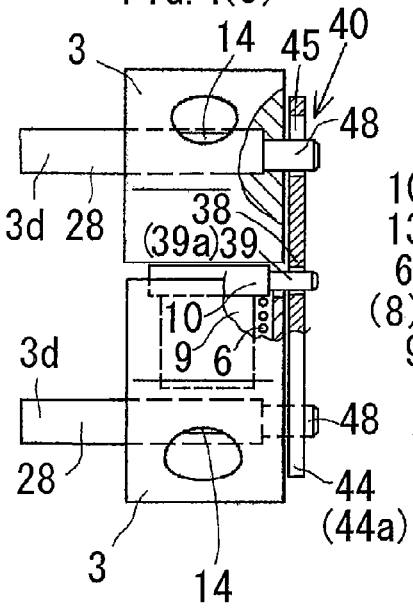
FIG. 1(C) is a partly broken side view.
Figure 1A:
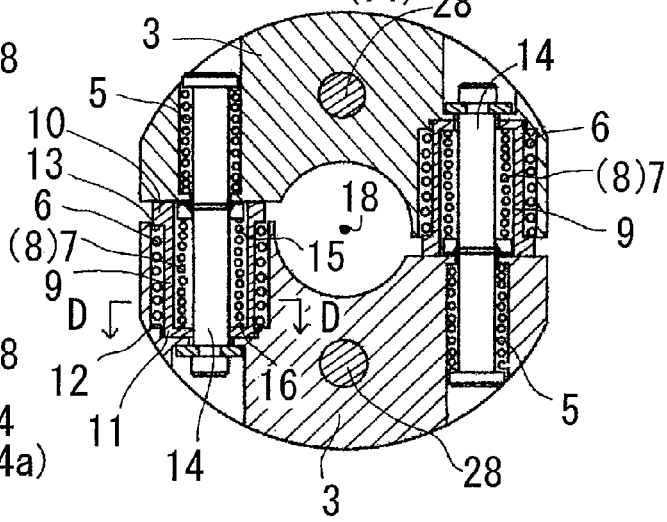
FIG. 1(A) is a sectional view taken along a line A-A of FIG. 1(B).
Figure 4A:
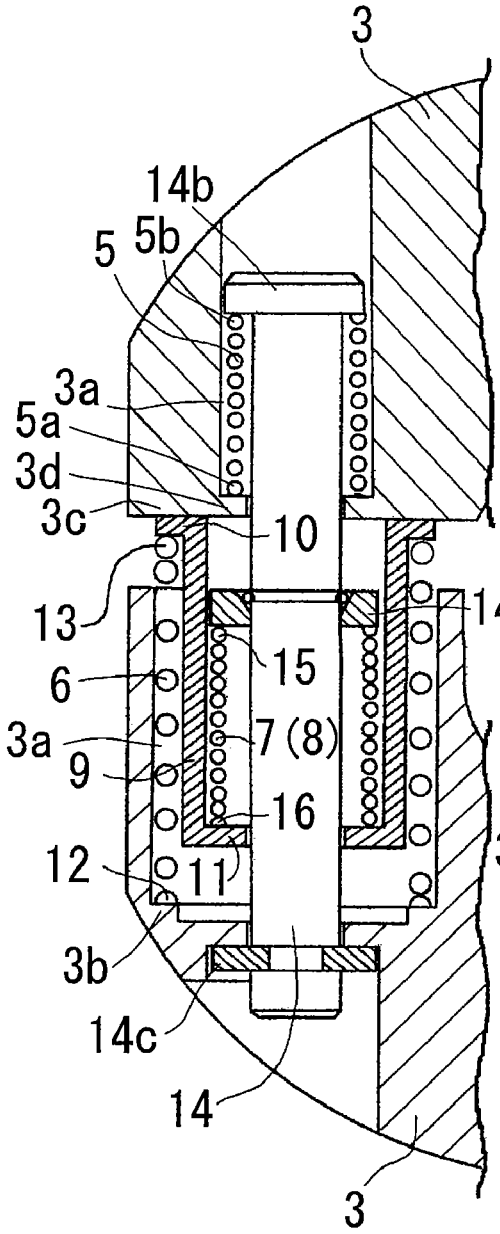
FIG. 4(A) shows an operation state when starting the engine during the cold term.
Figure 4B:
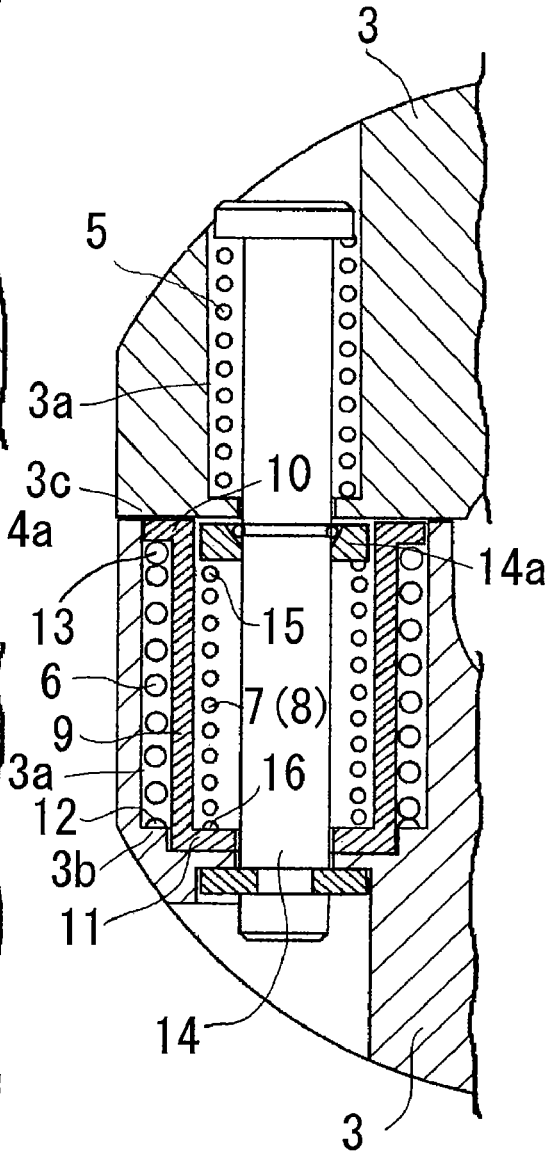
FIG. 4(B) shows another operation state while the engine is warm.

As shown in FIG. 1(A), each of the centrifugal weights 3 is interlockingly connected to an advancing spring 6 composed of a compression coil spring. This advancing spring 6 is interlockingly connected to a temperature-sensing operation means 7. As shown in FIG. 4(A), when starting the engine during a cold term, the advancing spring 6 is maintained extensible based on a state (contracted state) of the temperature-sensing operation means 7 in which the temperature-sensing operation means 7 senses a temperature to operate. This advancing spring 6 exerts a spring force which pushes and widens the pair of centrifugal weights 3 to an advancing position (Ac) for cold-staring the engine. As shown in FIG. 4(B), while the engine is warm, the advancing spring 6 is held contracted based on another state (extensible state) of the temperature-sensing operation means 7 in which the temperature-sensing operation means 7 senses a temperature to operate, so that the spring force of the advancing spring 6 does not act on the pair of centrifugal weights 3, 3. The warm term of the engine means a term during which the engine is in operation or the engine starts while it is warm.

The temperature-sensing operation means is constructed as follows.

As shown in FIG. 1(A), a shape memory spring 8 composed of a compression coil spring is used for the temperature-sensing operation means 7. This shape memory spring 8 and the advancing spring 6 are interposed between the pair of centrifugal weights 3, 3 in a position concentric with the weight-return spring 5. As for the shape memory spring 8 to be used, it is made of a shape memory alloy and has a property of contracting when the engine is started during the cold term and of extending while the engine is warm.

The arrangement of the shape memory spring and the like is outlined as follows.

As shown in FIG. 1(A), one of the paired centrifugal weights 3, 3 has an interior area formed with a spring accommodating hole 3*a* which accommodates the weight-return spring 5 and the other of the paired centrifugal weights 3, 3 has an interior area provided with a spring accommodating hole 3*a* which accommodates the advancing spring 6 and the shape memory spring 8. The shape memory spring 8 and the advancing spring 6 are formed into a double structure where one of them is positioned inside and the other is arranged outside.

The arrangement of the shape memory spring and the like is recited in detail as follows.

As shown in FIGS. 4(A) and 4(B), the spring accommodating hole 3*a* of the one centrifugal weight 3 which accommodates the advancing spring 6 has an inner bottom provided with a first spring seat 3*b*, on which the advancing spring 6 has its base end portion 12 seated. A transmission cylinder 9 is arranged concentrically within this advancing spring 6. The transmission cylinder 9 has a leading end portion near a leading end portion 13 of the advancing spring 6. A first spring retainer 10 is provided at this leading end portion of the transmission cylinder 9 outwardly. This first spring retainer 10 receives the leading end portion 13 of the advancing spring 6 and is brought into contact with a retainer-receiving surface 3*c* of the centrifugal weight 3 which accommodates the weight-return spring 5.

An axis 14 is attached to the centrifugal weight 3 which accommodates the advancing spring 6. This axis 14 is arranged concentrically within the transmission cylinder 9 and is provided with a second spring seat 14*a*, on which the shape memory spring 8 has its base end portion 15 seated. This shape memory spring 8 is arranged concentrically between the axis 14 and the transmission cylinder 9. The transmission cylinder 9 has another leading end portion close to a leading end portion 16 of the shape memory spring 8. A second spring retainer 11 is provided at this another leading end portion of the transmission cylinder 9 inwardly. This second spring retainer 11 receives the leading end portion 16 of the shape memory spring 8. The aforesaid axis 14 is a guide axis to open and close the pair of centrifugal weights 3, 3 and is inserted into the spring accommodating hole 3*a* which accommodates the weight-return spring 5. This spring accommodating hole 3*a* has an inner bottom provided with a third spring seat 3*d*, on which the weight-return spring 5 has its base end portion 5*a* seated. This weight-return spring 5 is concentrically arranged outside the axis 14. This axis 14 has a leading end provided with a third spring retainer 14*b*. This third spring retainer 14*b* receives a leading end portion 5*b* of the weight-return spring 5. The axis 14 has a base end portion provided with a washer 14*c* which is brought into contact with the centrifugal weight 3 on the side of the advancing spring 6 so as to prevent the axis 14 from being dismantled by the spring force of the weight-return spring 5.

As shown in FIG. 4(A), when starting the engine during the cold term, the advancing spring 6 is maintained extensible based on the sate of the contracted shape memory spring 8, in which the shape memory spring 8 senses a temperature to operate, and has its spring force act on the first spring seat 3*b* and the retainer-receiving surface 3*c*, thereby enabling the paired centrifugal weights 3, 3 to be pushed and widened to the advancing position (Ac).

As shown in FIG. 4(B), while the engine is warm, the advancing spring 6 is held contracted based on another state of the extended shape memory spring 8, in which the shape memory spring 8 senses a temperature to operate, so that the spring force of the advancing spring 6 does not act on the first spring seat 3*b* and the retainer-receiving surface 3*c*.

The structure for switching over an upper limit of the degree of the advancement is outlined as follows.

Figure 1E:
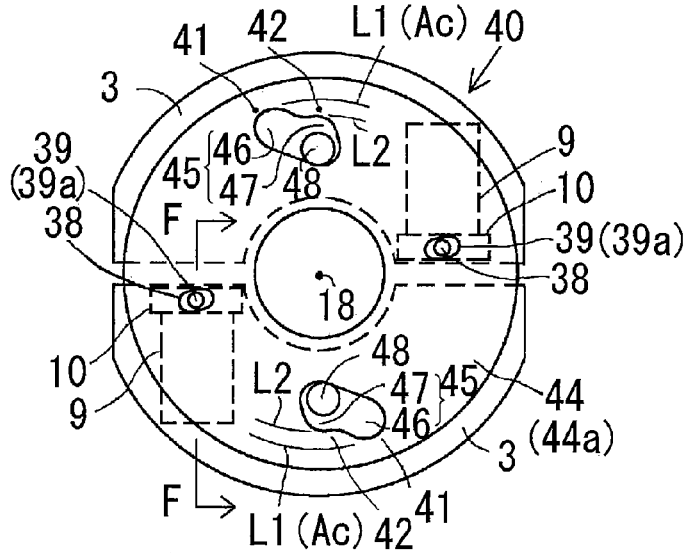
FIG. 1(E) is a view when seen in a direction indicated by an arrow (E) in FIG. 1(B).

As shown in FIG. 1(E), a first limiting member of advancement 41 and a second limiting member of advancement 42 are interlockingly connected to the shape memory spring 8 through an output means 39 and a limitation switch-over means 44 so that they can be switched over.

Figure 5A:
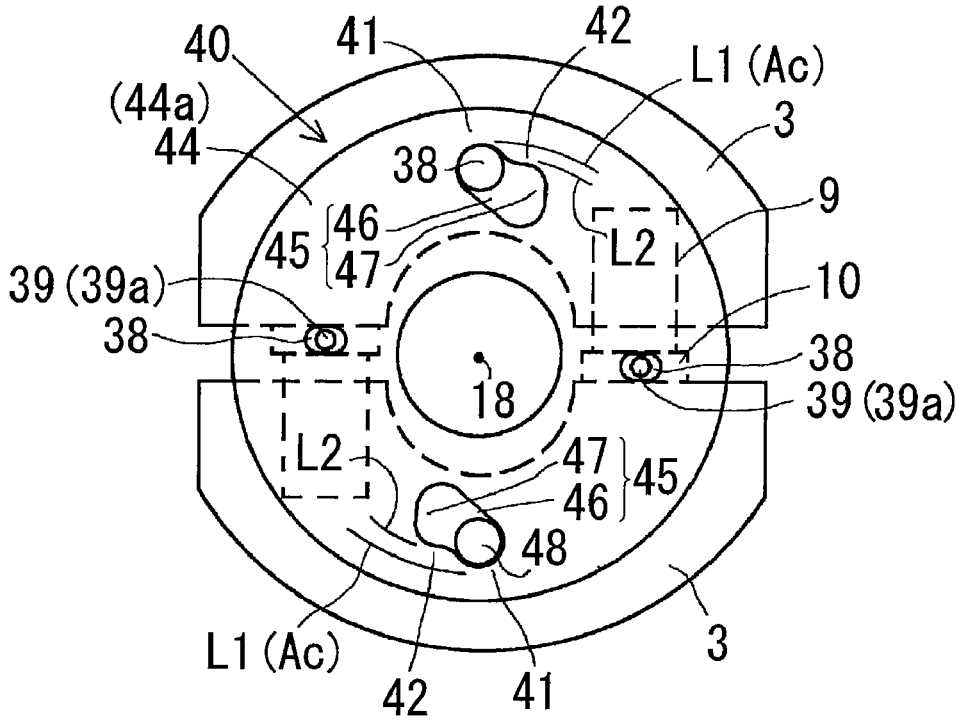
FIG. 5(A) shows a state when starting the engine during the cold term.

As shown in FIG. 5(A), when starting the engine during the cold term, the first limiting member of advancement 41 is arranged so that it can make limitation based on the state (contracted state) of the shape memory spring 8, in which the shape memory spring 8 senses a temperature to operate, through the output means 39 and the limitation switch-over means 44. This first limiting member of advancement 41 confines an upper limit of the movement of every centrifugal weight 3 in the centrifugal direction to a first limiting position of advancement (L1).

Figure 5B:
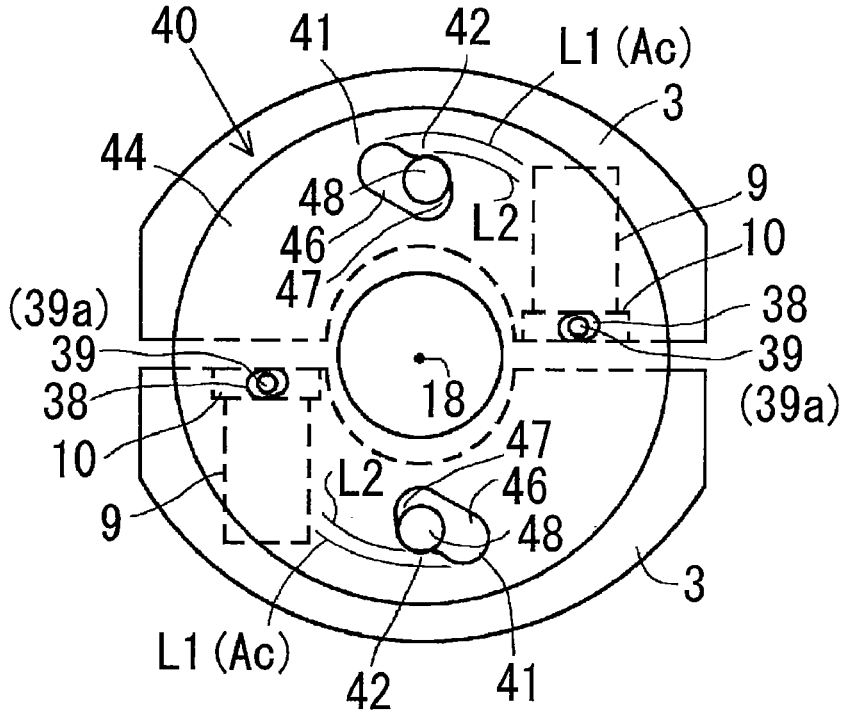
FIG. 5(B) shows another state while the engine is warm.
Figure 6A:
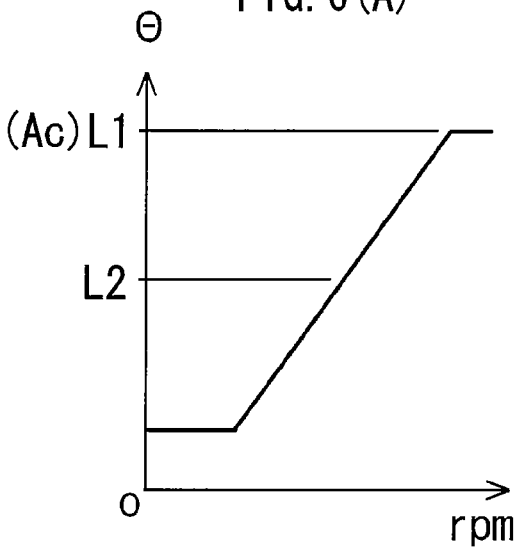
FIG. 6(A) shows a state when starting the engine during the cold term.
Figure 6B:
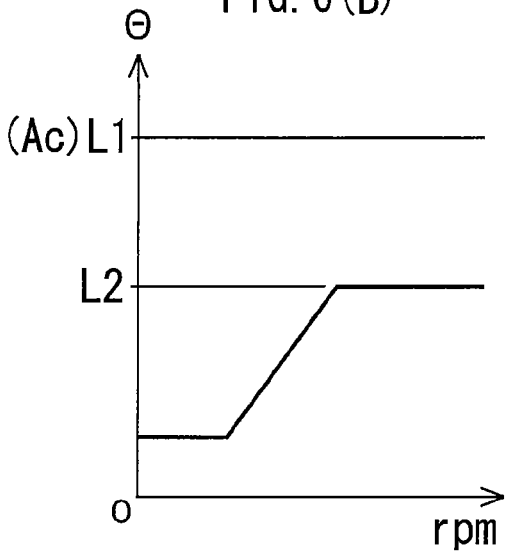
FIG. 6(B) shows another state while the engine is warm.
Figure 7A:
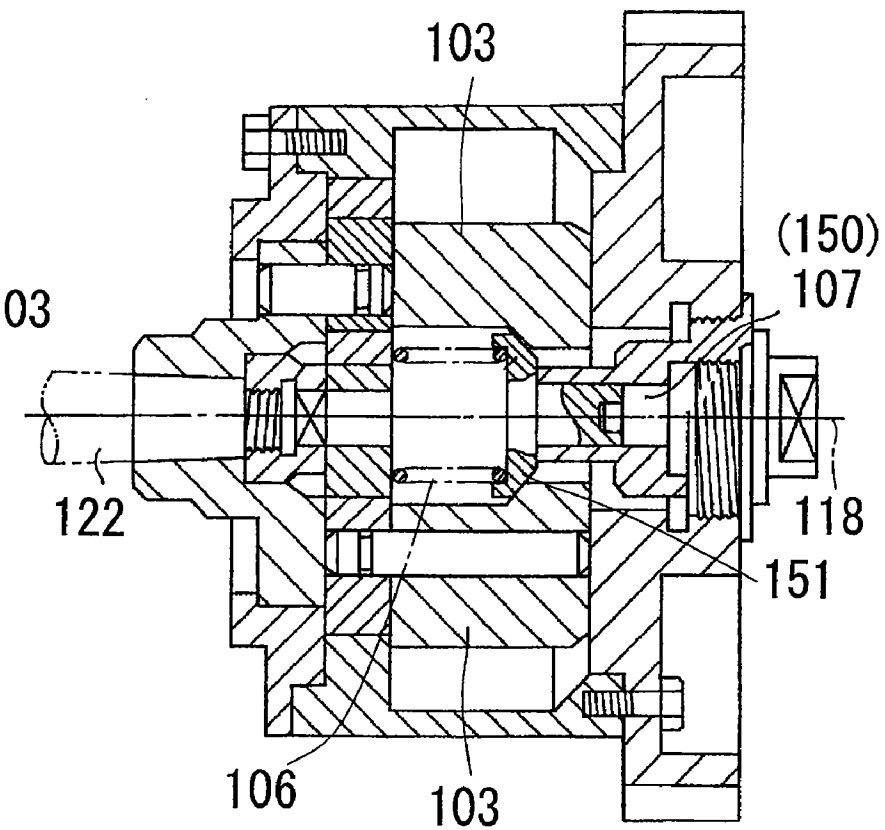
FIG. 7(A) PRIOR ART
FIG. 7(A) is a sectional view taken along a line A-A shown in FIG. 7(B).
Figure 7B:
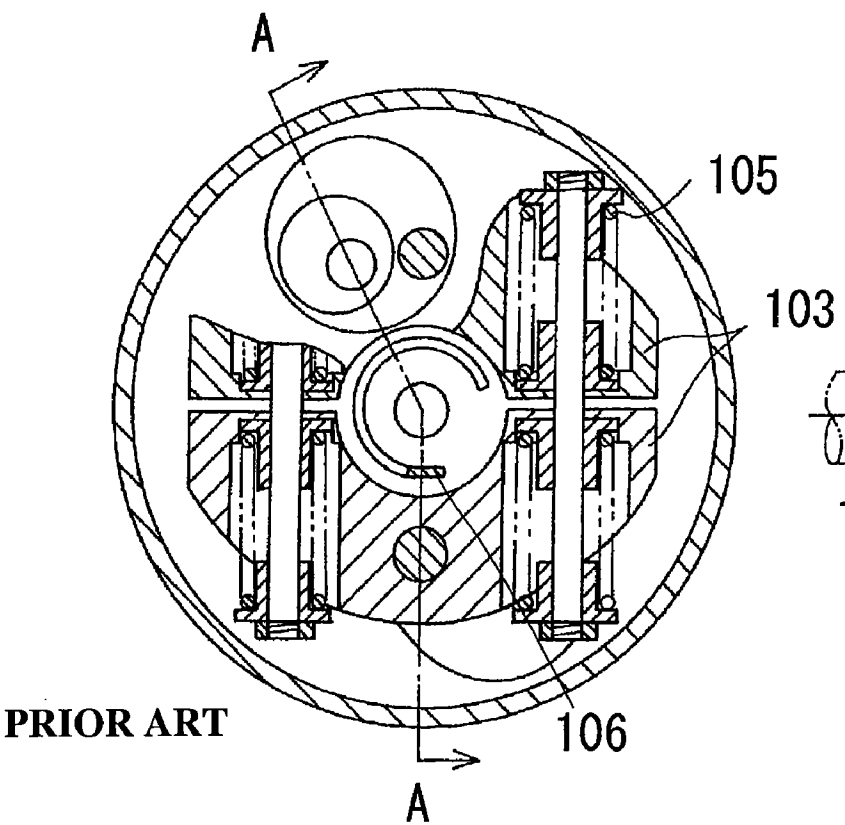
FIG. 7(B) PRIOR ART
FIG. 7(B) is a vertical sectional front view.

As shown in FIG. 5(B), while the engine is warm, the second limiting member of advancement 42 is arranged so that it can make limitation based on the another state (extensible state) of the shape memory spring 8, in which the shape memory spring 8 senses a temperature to operate, through the output means 39 and the limitation switch-over means 44. This second limiting member of advancement 42 confines the upper limit of the movement of every centrifugal weight 3 in the centrifugal direction to a second limiting position of advancement (L2).

The second limiting position of advancement (L2) lowers the upper limit of the movement of every centrifugal weight 3 in the centrifugal direction so as to make an upper limit of a degree of advancement (θ) lower when compared with the first limiting position of advancement (L1).

This second limiting position of advancement (L2) comes to be the advancing position (Ac) for cold-starting the engine.

The structure for switching over the upper limit of the degree of advancement is described in detail as follows.

As shown in FIG. 1(E), a rotating plate 44*a* is utilized for an alternative switch-over means 44. The rotating plate 44*a* is provided at one lateral portion of the paired centrifugal weights 3, 3 and is made rotatable around a center line 18 of rotation of the rotary shaft 22.

The rotating plate 44*a* is provided with a first limiting hole of advancement 46 and with a second limiting hole of advancement 47. The first and second limiting holes of advancement 46 and 47 are arranged side by side in a rotation direction of the centrifugal weight 3 and are communicated with each other to form a communication hole 45.

The first limiting hole of advancement 46 has a peripheral edge portion on a centrifugal side, which forms the first limiting member of advancement 41 and the second limiting hole of advancement 47 has a peripheral edge portion on the centrifugal side, which forms the second limiting member of advancement 42. Each of the centrifugal weights 3, 3 projects an engaging projection 48 into the communication hole 45.

As shown in FIG. 5(A), when starting the engine during the cold term, the rotating plate 44*a* is placed in a first rotating position based on the state (contracted state) of the shape memory spring 8 in which shape memory spring 8 senses a temperature to operate. The first limiting member of advancement 41 can receive the engaging projection 48.

As shown in FIG. 5(B), while the engine is warm, the rotating plate 44*a* is placed in a second rotating position based on another state (extensible state) of the shape memory spring 8 in which the shape memory spring 8 senses a temperature to operate. The second limiting member of advancement 42 can receive the engaging projection 48.

Other devices are as follows.

Figure 1F:
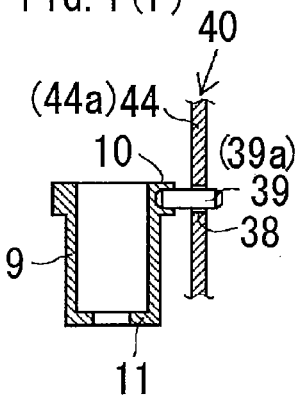
FIG. 1(F) is a sectional view taken along a line F-F in FIG. 1(E)

As shown in FIG. 3(A), while the rotating plate 44*a* is provided at one lateral portion of the paired centrifugal weights 3, 3, the eccentric cam mechanism 4 is arranged at the other lateral portion thereof. A pin 28 passes through each of the centrifugal weights 3. This pin 28 has one end portion which serves as the engaging projection 48 and has the other end portion which serves as the output pin 3*d* extending from every centrifugal weight 3 to the eccentric cam mechanism 4. As shown in FIG. 1F, an output pin 39*a* is employed for the output means 39 from the shape memory spring 8. The rotating plate 44 is opened to provide an engaging hole 38 with which the output pin 39*a* engages. The output pin 39*a* is attached to the first spring retainer 10.

What is claimed is:

1. An engine timer comprising a predetermined rotary shaft (22) to which a driving wheel (1) is attached, the driving wheel (1) having one lateral portion at which a driven wheel (2) is arranged and having the other lateral portion at which a pair of centrifugal weights (3, 3) are arranged, respectively, each of the paired centrifugal weights (3, 3) being urged in a centripetal direction by a weight-return spring (5) composed of a compression coil spring, there being provided between the driving wheel (1) and the driven wheel (2) an eccentric cam mechanism (4) which is interlockingly connected to the pair of centrifugal weights (3, 3), wherein a force of unbalance between a centrifugal force of each of the paired centrifugal weights (3, 3) and an urging force of the weight-return spring (5) operating the respective centrifugal weights (3, 3), when each of the centrifugal weights (3, 3) moves in a centrifugal direction, it advances the driven wheel (2) with respect to the driving wheel (1) through the eccentric cam mechanism (4) and when each of the paired centrifugal weights (3, 3) moves in a centripetal direction, it lags the driven wheel (2) with respect to the driving wheel (1) through the eccentric cam mechanism (4), and wherein each of the paired centrifugal weights (3, 3) is interlockingly connected to an advancing spring (6), composed of a compression coil spring, which is interlockingly connected to a temperature-sensing operation means (7), when starting the engine during a cold term, the advancing spring (6) being maintained extensible based on a state of the temperature-sensing operation means (7), in which the temperature-sensing means (7) senses a temperature to operate, and exerting a spring force which pushes and widens the paired centrifugal weights (3, 3) to an advancing position (Ac) for cold-staring the engine and while the engine is warm, the advancing spring (6) being held contracted based on another state of the temperature-sensing operation means (7), in which the temperature-sensing operation means (7) senses a temperature to operate, so that the spring force of the advancing spring (6) does not act on the pair of centrifugal weights (3, 3), a shape memory spring (8) of a compression coil spring being used for the temperature-sensing operation means (7), the shape memory spring (8) and the advancing spring (6) being interposed between the pair of centrifugal weights (3, 3) in a position concentric with the weight-return spring (5).

2. The engine timer as set forth in claim 1, wherein one of the paired centrifugal weights (3, 3) has an interior area formed with a spring accommodating hole (3*a*) which accommodates the weight-return spring (5) and the other of the paired centrifugal weights (3, 3) has an interior area provided with another spring accommodating hole (3*a*) which accommodates the advancing spring (6) and the shape memory spring (8).

3. The engine timer as set forth in claim 2, wherein the shape memory spring (8) and the advancing spring (6) are formed into a double structure where one of them is arranged inside and the other is disposed outside.

4. The engine timer as set forth in claim 3, wherein the spring accommodating hole (3*a*) which accommodates the advancing spring (6) has an inner bottom provided with a first spring seat (3*b*), on which the advancing spring (6) has its base end portion (12) seated, and a transmission cylinder (9) is concentrically arranged within the advancing spring (6) and has a leading end portion near a leading end portion (13) of the advancing spring (6), this leading end portion of the transmission cylinder (9) being provided with a first spring retainer (10) outwardly, the first spring retainer (10) receiving the leading end portion (13) of the advancing spring (6) and being brought into contact with a retainer-receiving surface (3*c*) of the centrifugal weight (3) which accommodates the weight-return spring (5), and wherein an axis (14) is attached to the centrifugal weight (3) which accommodates the advancing spring (6) and is concentrically arranged within the transmission cylinder (9), the axis (14) being provided with a second spring seat (14*a*) on which the shape memory spring (8) has its base end portion (15) seated, and the shape memory spring (8) is concentrically arranged between the axis (14) and the transmission cylinder (9), the transmission cylinder (9) having another leading end portion close to a leading end portion (16) of the shape memory spring (8), this another leading end portion of the transmission cylinder (9) being provided with a second spring retainer (11) inwardly, the second spring retainer (11) receiving the leading end portion (16) of the shape memory spring (8), when starting the engine during the cold term, the advancing spring (6) being maintained extensible based on a state of the contracted shape memory spring (8) in which the shape memory spring (8) senses a temperature to operate, and being made to act its spring force on the first spring seat (3*b*) and the retainer-receiving surface (3*c*), thereby enabling the paired centrifugal weights (3, 3) to be pushed and widened to the advancing position (Ac), while the engine is warm, the advancing spring (6) being held contracted based on another state of the extended shape memory spring (8), in which the shape memory spring (8) senses a temperature to operate, so that the spring force of the advancing spring (6) does not act on the first spring seat (3*b*) and the retainer-receiving surface (3*c*).

5. The engine timer as set forth in claim 1, wherein a first limiting member of advancement (41) and a second limiting member of advancement (42) are interlockingly connected to the shape memory spring (8) through an output means (39) and a limitation switch-over means (44) so that they are able to be switched over, when starting the engine during the cold term, the first limiting member of advancement (41) being able to make limitation, based on the state of the shape memory spring (8), in which the shape memory spring (8) senses a temperature to operate, through the output means (39) and the limitation switch-over means (44) and confining an upper limit of a movement of every centrifugal weight (3) in a centrifugal direction to a first limiting position of advancement (L1), while the engine is warm, the second limiting member of advancement (42) being able to make limitation, based on the another state of the shape memory spring (8), in which the shape memory spring (8) senses a temperature to operate, through the output means (39) and the limitation switch-over means (44) and confining the upper limit of the movement of every centrifugal weight (3) in the centrifugal direction to a second limiting position of advancement (L2), the second limiting position of advancement (L2) being arranged so that the upper limit of the movement of every centrifugal weight (3) in the centrifugal direction is set lower so as to make an upper limit of a degree of advancement (θ) lower when compared with the first limiting position of advancement (L1).

6. The engine timer as set forth in claim 5, wherein a rotating plate (44*a*) is used for the limitation switch-over means (44) and is provided at one lateral portion of the paired centrifugal weights (3, 3), the rotating plate (44*a*) being able to rotate around a center line (18) of rotation of the rotary shaft (22), and the rotating plate (44*a*) is opened to provide a first limiting hole of advancement (46) and a second limiting hole of advancement (47) both of which are arranged side by side in a rotation direction of the centrifugal weight (3) and are communicated with each other to provide a communication hole (45), the first limiting hole of advancement (46) having a peripheral edge portion on a centrifugal side, which forms the first limiting member of advancement (41) and the second limiting hole of advancement (47) having a peripheral edge portion on the centrifugal side, which forms the second limiting member of advancement (42), respectively, each of the paired centrifugal weights (3, 3) projecting an engaging projection (48) into the communication hole (45), when starting the engine during the cold term, the rotating plate (44*a*) being placed in a first position based on the state of the shape memory spring (8) in which the shape memory spring (8) senses a temperature to operate, the first limiting member of advancement (41) being able to receive the engaging projection (48), while the engine is warm, the rotating plate (44*a*) being placed in a second position based on the another state of the shape memory spring (8) in which the shape memory spring (8) senses a temperature to operate, the second limiting member of advancement (42) being able to receive the engaging projection (48).

7. The engine timer as set forth in claim 6, wherein the rotating plate (44*a*) is provided at one lateral portion of the paired centrifugal weights (3, 3) and on the other hand, the eccentric cam mechanism (4) is arranged at the other lateral portion thereof, a pin (28) passing through each of the centrifugal weights (3, 3) and having one end portion which serves as the engaging projection (48) and the other end portion which serves as an output pin (3*d*) extending from each of the centrifugal weighs (3, 3) to the eccentric cam mechanism (4).

8. The engine timer as set forth in claim 6, wherein an output pin (39*a*) is used for the output means (39) from the shape memory spring (8) and the rotating pin (44*a*) is opened to provide an engaging hole (38) with which the output pin (39*a*) engages.

* * * * *